US006921618B2

(12) United States Patent
Hongo et al.

(10) Patent No.: US 6,921,618 B2
(45) Date of Patent: Jul. 26, 2005

(54) PHOTOCONDUCTIVE ORGANIC PIGMENT, PHOTOCONDUCTIVE ORGANIC PIGMENT DISPERSION LIQUID, ELECTROPHOTOGRAPHIC PHOTORECEPTOR AND ELECTROPHOTOGRAPHIC DEVICE USING THE SAME

(75) Inventors: Kazuya Hongo, Minamiashigara (JP); Seiichi Takagi, Minamiashigara (JP)

(73) Assignee: Fuji Xerox Co., Ltd., Tokyo (JP)

( * ) Notice: Subject to any disclaimer, the term of this patent is extended or adjusted under 35 U.S.C. 154(b) by 0 days.

(21) Appl. No.: 10/388,811

(22) Filed: Mar. 17, 2003

(65) Prior Publication Data

US 2004/0063013 A1 Apr. 1, 2004

(30) Foreign Application Priority Data

Sep. 30, 2002 (JP) ..... 2002-287959

(51) Int. Cl.[7] ..... G03G 5/06

(52) U.S. Cl. ..... 430/59.1; 430/56; 430/59.4; 399/159

(58) Field of Search ..... 430/59.1, 56, 59.4; 399/159; 252/501.1

(56) References Cited

U.S. PATENT DOCUMENTS

| | | | | |
|---|---|---|---|---|
| 3,799,340 A | * | 3/1974 | Tamai et al. | 209/127.1 |
| 3,909,261 A | * | 9/1975 | Jones | 430/58.6 |
| 6,255,027 B1 | * | 7/2001 | Wehelie et al. | 430/65 |

FOREIGN PATENT DOCUMENTS

| | | |
|---|---|---|
| JP | A 62-272272 | 11/1987 |
| JP | A 2-183261 | 7/1990 |
| JP | A 2-280169 | 11/1990 |

* cited by examiner

*Primary Examiner*—John L Goodrow
(74) *Attorney, Agent, or Firm*—Oliff & Berridge, PLC

(57) ABSTRACT

The present invention relates to a photoconductive organic pigment comprising granular cores and an organic pigment having photoconductive properties which organic pigment adheres to the surfaces of the granular cores, a photoconductive organic pigment dispersion liquid comprising the photoconductive organic pigment, and an electrophotographic photoreceptor comprising an electroconductive substrate laminated with a photosensitive layer containing the photoconductive organic pigment and an electrophotographic device using the electrophotographic photoreceptor.

16 Claims, 3 Drawing Sheets

PHOTOCONDUCTIVE ORGANIC PIGMENT, PHOTOCONDUCTIVE ORGANIC PIGMENT DISPERSION LIQUID, ELECTROPHOTOGRAPHIC PHOTORECEPTOR AND ELECTROPHOTOGRAPHIC DEVICE USING THE SAME

BACKGROUND OF THE INVENTION

1. Field of the Invention

The present invention relates to photoconductive organic pigment, a photographic organic pigment dispersion liquid, and an electrophotographic photoreceptor and an electrophotographic device using the same.

2. Description of the Related Art

As electrophotographic photoreceptors used in monochrome and full-color copiers, printers, facsimiles, digital copiers and the like, inorganic and organic photoreceptors are known. Among them, organic photoreceptors are principally used because they are not only environmentally friendly, but also possess advantages such as high productivity and low cost. Further, in the organic photoreceptors, photosensitivity can be controlled by selecting materials such as a charge generating material, a binder resin, a solvent and a sensitizer, and thus these materials are the subjects of extensive study.

Meanwhile, a laminated electrophotographic photoreceptor having a charge generating layer and a charge transporting layer as photosensitive layers has been proposed.

It is essential that this laminated electrophotographic photoreceptor possesses the required light sensitivity, image characteristics, shelf stability and the like to meet the needs of the electrophotographic process to which it is applied, and these characteristics are affected by the light sensitivity, chemical and physical stability and dispersibility of the charge generating material.

The charge generating material used in electrophotographic photoreceptors includes known photoconductive organic pigments such as polycyclic quinone pigments, perylene pigments, azo pigments, indigo pigments, quinacridone pigments and phthalocyanine pigments. Organic pigments can be synthesized more easily than inorganic materials, and can also be selected from a broader range of compounds exhibiting photoconductivity in a suitable wavelength range, and thus, a large number of photoconductive organic pigments have been proposed.

When the above-mentioned photoconductive organic pigments are used as the charge generating material, crude pigment crystals obtained by various synthesis methods are subjected to milling treatment, acid pasting treatment, solvent treatment and/or heat treatment thus changing their crystal form and regulating their particle diameter. By controlling the particle diameter, the sensitivity required for the charge generating material, and the photoreceptor characteristics such as light sensitivity, charging property, dark decay, environmental characteristics and cycle characteristics and the dispersibility, suitable coating and the like can be obtained in the production process.

Generally, the sensitivity of an electrophotographic photoreceptor using the photoconductive organic pigment as the charge generating material is almost always determined by the pigment used, and thus, selecting a pigment possessing the sensitivity required for the electrophotographic process is necessary in designing the electrophotographic photoreceptor. However, the required light sensitivity of the electrophotographic process does not necessarily conform with the light sensitivity of the electrophotographic photoreceptor, and problems may arise such as the thickening and thinning of thin lines, blurring and insufficient density. Hence, in order to achieve the formation of high-quality images, there is a limit to the selection of charge generating materials. Further, when highly light sensitive electrophotographic photoreceptors are used for small laser printers such as those widely used in homes or offices or for full-color printers/copiers of which high resolution is required, problems arise such as deterioration in resolution and in halftone reproduction, so there is a limit to the direct use of highly light sensitive pigments as the charge generating material.

When a charge generating material is dispersed in a resin, there are known methods wherein a binder resin or solvent used is changed or a mixing ratio of a pigment to resin is changed in order to regulate the sensitivity of the electrophotographic photoreceptor within a desired range, but these methods are subject to restriction on the structure or production of the photoreceptor, thus limiting the usable materials, so the actually required sensitivity is difficult to attain.

The regulation of sensitivity by using a mixture of a plurality of pigments has also been reported. For example, Japanese Patent Application Laid-Open (JP-A) No. 62-272272 describes use of $\alpha$-type and $\beta$-type titanyl phthalocyanine pigments, and JP-A No. 2-183261 describes that a titanyl phthalocyanine pigment having a crystal form giving diffraction peaks at 9.6°, 11.7°, 24.1° and 27.2° in the Bragg angle ($2\theta \pm 0.2°$) is mixed with a titanyl phthalocyanine pigment having a crystal form giving a peak at 6.9°, 15.5° and 23.4° and it is known that titanyl phthalocyanine pigments different in crystal form are mixed in a different ratio to regulate the light sensitivity. Further, JP-A No. 2-280169 describes that different kinds of phthalocyanine pigments are mixed with the titanyl phthalocyanine pigment to regulate the sensitivity.

However, the range of the regulated sensitivity of the electrophotographic photoreceptor indicated in the above-listed publications is not always satisfactory, and the sensitivity varies depending on the pigment lot, making sensitivity regulation difficult. When the electrophotographic photoreceptor is used in which a charge generating material is dispersed in a resin, there are problems such as unsatisfactory dispersibility and shelf stability of the dispersion in practical use, a significant change in electric potential upon repeated use, and a significant change in characteristics in high- or low-humidity environments. Further, there are problems such as complicated production processes and higher cost. Accordingly, there is a need to truly understand sensitivity-regulating factors of photoconductive organic pigments used in the photoreceptor and to obtain photoconductive organic pigments capable of coping with demand for various light sensitivities.

SUMMARY OF THE INVENTION

The object of the present invention is to solve the various problems in the prior art to achieve the following objects. That is, an object of the invention is to provide a photoconductive organic pigment which has desired light sensitivity, exhibits excellent electrophotographic characteristics giving images of good qualities, and is excellent in dispersibility in binder resin, as well as a photoconductive organic pigment dispersion liquid using the photoconductive organic pigment. Another object of the invention is to provide an electrophotographic photoreceptor having light sensitivity capable of easy adaptation to the required light sensitivity of a light source for use in light exposure, to obtain images of good qualities, as well as an electrophotographic device using the same.

The inventors confirmed that use of a photoconductive organic pigment comprising granular cores and an organic pigment having photoconductive properties which organic pigment adheres to the surfaces of the granular cores as the charge generating material in an electrophotographic photoreceptor can achieve excellent dispersibility and a broader range of regulated sensitivity with less variation in light sensitivity depending on the pigment lots to obtain images of good qualities, and they simultaneously found that the objects of the invention can be achieved, and the invention has been completed.

A first aspect of the invention provides a photoconductive organic pigment comprising granular cores and an organic pigment having photoconductive properties which organic pigment adheres to the surfaces of the granular cores.

A second aspect of the invention provides a photoconductive organic pigment dispersion liquid comprising the photoconductive organic pigment described above.

A third aspect of the invention provides an electrophotographic photoreceptor comprising an electroconductive substrate laminated with a photosensitive layer containing the photoconductive organic pigment described above.

A fourth aspect of the invention provides an electrophotographic device comprising the electrophotographic photoreceptor, a charging unit for charging the electrophotographic photoreceptor, a light exposing unit for exposing imagewise the charged electrophotographic photoreceptor to light to form an electrostatic latent image on the surface of the electrophotographic photoreceptor, a developing unit for developing the electrostatic latent image so as to obtain a toner image, and a transferring unit for transferring the toner image to a recording material.

According to the invention, the photoconductive organic pigment comprising granular cores and an organic pigment, which has photoconductive properties, adhering to the surfaces of the granular cores has sensitivity capable of being regulated in abroad range, excellent in dispersibility in a resin dispersion liquid and in storage stability, and having excellent electrophotographic characteristics. Further, the photoconductive organic pigment dispersion liquid containing the photoconductive organic pigment of the invention has good dispersibility and coating stability. Further, the electrophotographic photoreceptor of the invention and the electrophotographic device using the same can adjust the light sensitivity of the electrophotographic photoreceptor to the required optimum sensitivity of the electrophotographic process, and are thus free of image defects such as blurring, black spots, white spots and the like, and outputted full-color images can be vivid images free of color unevenness, uneven density, and a reduction in resolution.

DETAILED DESCRIPTION OF THE PREFERRED EMBODIMENTS

Figure 1:
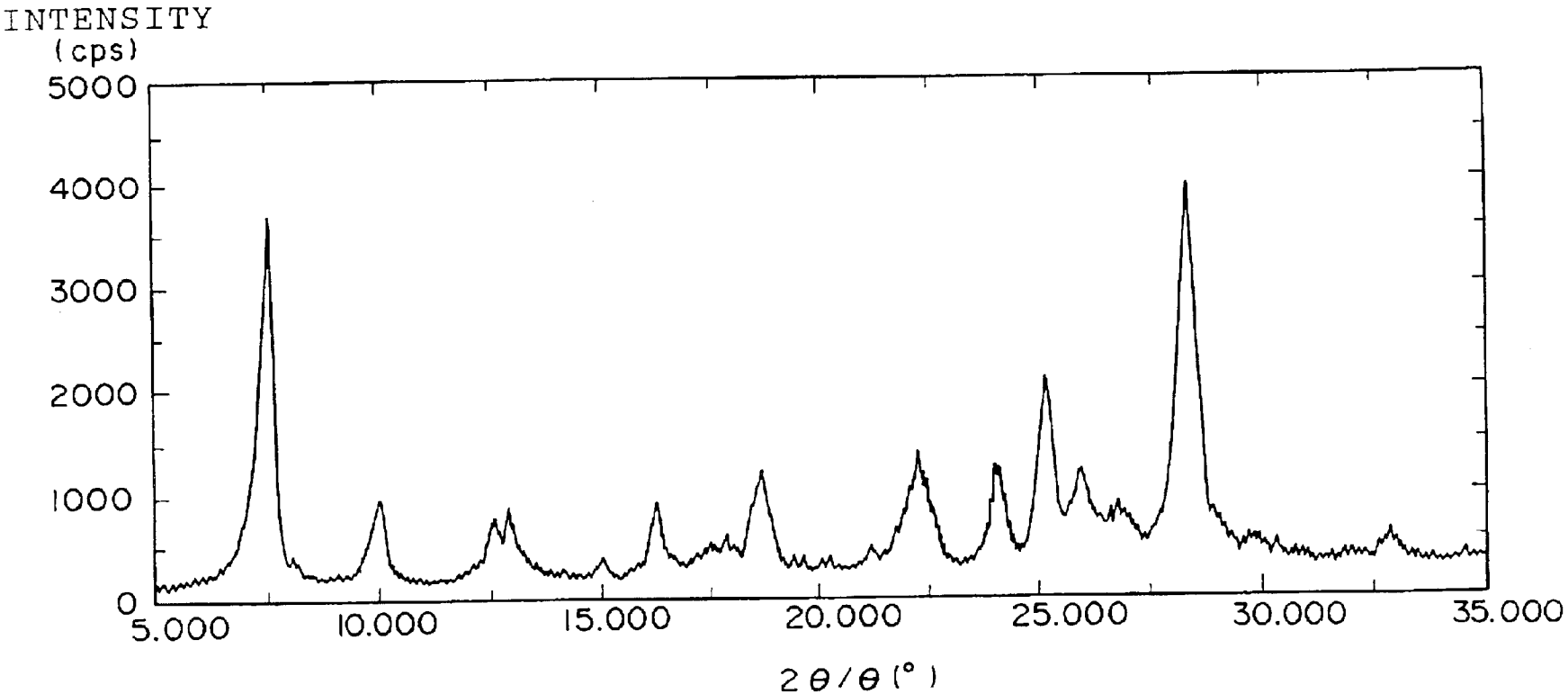
FIG. 1 is an X-ray diffraction pattern of the V-type hydroxygallium phthalocyanine pigment powder obtained in Synthesis Example 1 in the Examples.
Figure 2:
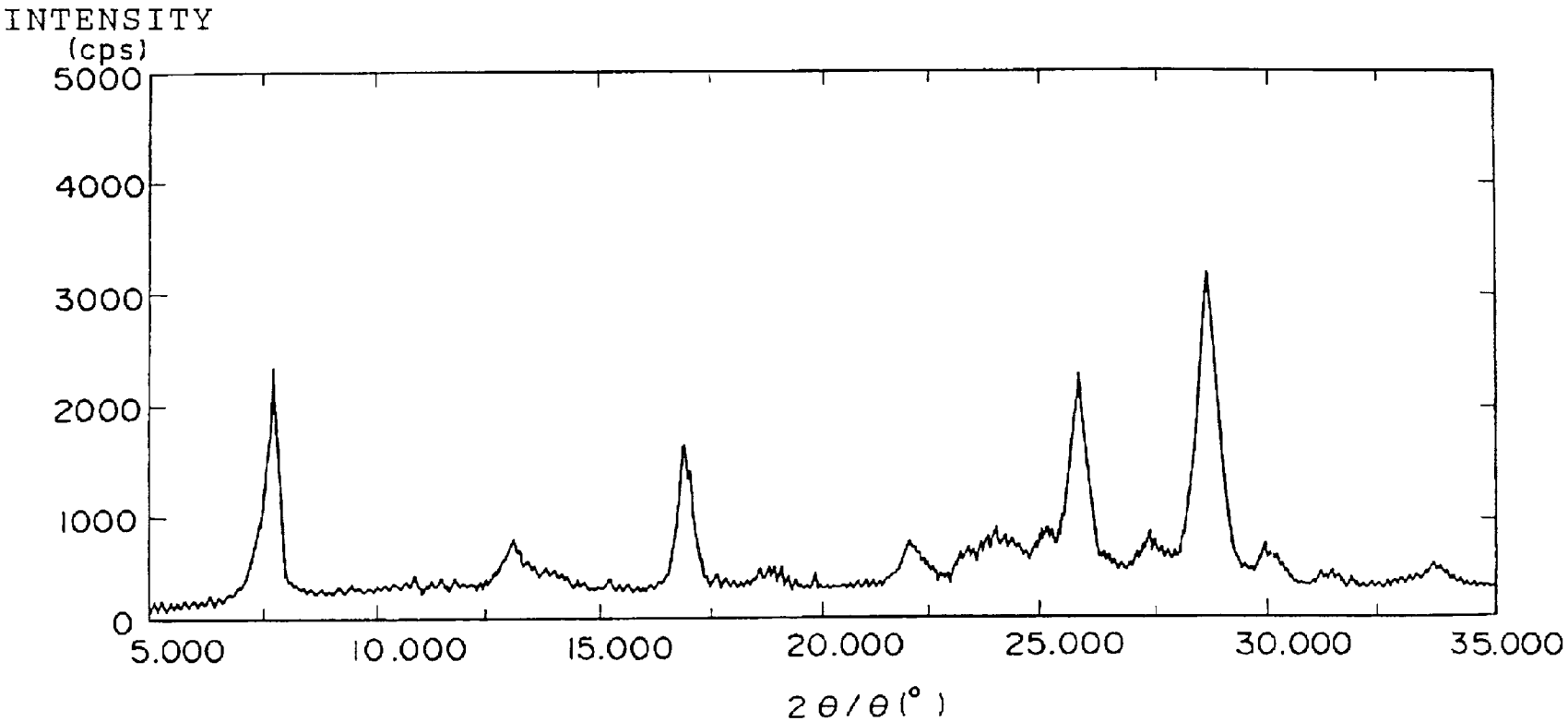
FIG. 2 is an X-ray diffraction pattern of the II-type chlorogallium phthalocyanine pigment powder obtained in Synthesis Example 2 in Example 1.

Hereinafter, the invention is described in more detail. Photoconductive organic pigment Each of the cores of the photoconductive organic pigment in the invention is granule, the surface of said granule having adhered thereto an organic pigment which possesses photoconductive properties.

The amount of the organic pigment adhering to the granular cores is selected in the range of 1 to 100 parts by mass, and preferably 5 to 50 parts by mass, relative to 100 parts by mass of the granular cores. When the amount of the organic pigment having photoconductive properties is less than 1 part by mass, the uniform adhesion of the organic pigment to the surfaces of the granular cores becomes difficult thus bringing about poor light sensitivity and failing to achieve excellent dispersibility. On the other hand, when the amount of the organic pigment having photoconductive properties is higher than 100 parts by mass, the amount of the organic pigment having photoconductive properties is so high that the organic pigment having photoconductive properties is easily removed from the surfaces of the granules, resulting in deterioration in dispersibility and stability in a vehicle or resin composition.

The photoconductive organic pigment of the invention is preferably in the form of fine particles having an average major-axis length in the range of 5 to 1000 nm, and preferably 10 to 500 nm. If the average major-axis length is less than 5 nm, the particles are so small that the adhesion of the organic pigment having photoconductive properties to the surfaces of the granules is made difficult, while if the average major-axis length is greater than 1000 nm, the dispersibility of the photoconductive organic pigment in binder resin is deteriorated. Further, the photoconductive organic pigment is preferably in a spherical or elliptical form.

The material of the granular cores in the invention is preferably fine inorganic particles, and one or more kinds of fine inorganic particles selected from silica, titanium oxide, iron oxide, iron hydroxide, zinc oxide and alumina are used as such.

Examples of the organic pigment having photoconductive properties usable in the invention include, but are not limited to, known organic pigments such as polycyclic quinone pigments, perylene pigments, azo pigments, indigo pigments, quinacridone pigments and phthalocyanine pigments. Among them, phthalocyanine pigments such as nonmetallic phthalocyanine pigment, titanyl phthalocyanine pigment, copper phthalocyanine pigment, chlorogalliumphthalocyanine pigment, hydroxygallium phthalocyanine pigment, vanadyl phthalocyanine pigment, chloroindium phthalocyanine pigment and dichlorotin phthalocyanine pigment can be selected as organic pigments for charge generating materials in digital recording electrophotographic photoreceptors for use in laser printers, full-color copiers and the like.

In the invention, the surfaces of the granular cores may be coated with an intermediate coat and the organic pigment having photoconductive properties may adhere to the intermediate coat. By arranging the intermediate coat on the surfaces of the granular cores, the adhesion between the granular cores and the organic pigment having photoconductive properties can be improved.

The intermediate coat is selected from organic compounds such as polysiloxane and an organosilane compound formed from alkoxysilane and inorganic compounds such as aluminum hydroxide, aluminum oxide, silicon hydroxide and silicon oxide.

The photoconductive organic pigment in the invention can be obtained by mixing the granular cores with the intermediate coat material made of at least one selected from alkoxysilane, polysiloxane, aluminum hydroxide, aluminum oxide, silicon hydroxide and silicon oxide, to coat the surfaces of the granular cores with the intermediate coat, and then mixing the coated particles with the organic pigment described above, when the photoconductive organic pigment has the intermediate coat.

Coating of the granular cores with alkoxysilane or polysiloxane added may be carried out by mechanically mixing and stirring the granular cores with an alkoxysilane solution or polysiloxane or by spraying the granular cores with an alkoxysilane solution or polysiloxane while mechanically mixing and stirring. The surfaces of the granular cores are coated with almost all of the added alkoxy silane or polysiloxane.

A part of the applied alkoxysilane may be applied in the form of an organosilane compound formed from alkoxysilane formed via the coating step. In this case, the organosilane compound does not affect the adhesion of the organic pigment. In order to coat the surfaces of the granular cores uniformly with alkoxysilane or polysiloxane, it is preferable that aggregation of the granular cores is previously prevented by a mill. Even if an intermediate coat material other than alkoxysilane or polysiloxane is used in the invention, the intermediate coat can be obtained in the same manner as described above.

The device for mixing and stirring the granular cores with the organic pigment, for mixing and stirring the granular cores with the intermediate coat, and for mixing and stirring the organic pigment with the granular cores coated with the intermediate coat is preferably a device which can apply shear force to the powdery layer, and a device which can simultaneously effect shearing, stirring with a blade and compression, and for example a wheel kneader, ball kneader, blade kneader or roll kneader can be used as such. In the invention, a wheel kneader can be used more effectively.

Specifically, examples of the wheel kneader include an edge runner (equivalent to "mix muller", "Simpson mill" and "sand mill"), Multimul, Storz mill, wet pan mill, coner mill and ring muller, and an edge runner, Multimul, Storz mill, wet pan mill and ring muller are preferable, and an edge runner is more preferable. Examples of the ball kneader include a vibration mill. Examples of the blade kneader include a Henschel mixer, planetary mixer and Nauta mixer. Examples of the roll mixer include an extruder.

The mixing and stirring conditions are regulated suitably such that the line load is in the range of 19.6 to 1960 N/cm (2 to 200 kg/cm), preferably 98 to 1470 N/cm (10 to 150 kg/cm), and more preferably 147 to 980 N/cm (15 to 100 kg/cm) and the treatment time is in the range of 5 to 120 minutes, and preferably 10 to 90 minutes, so as to coat the surfaces of the granular cores as uniformly as possible with the intermediate coat. The treatment conditions may be suitably regulated such that the stirring rate is in the range of 2 to 2000 rpm, preferably 5 to 1000 rpm, and more preferably 10 to 800 rpm.

The amount of the intermediate coat such as alkoxysilane or polysiloxane is preferably 0.15 to 45 parts by mass based on 100 parts by mass of the granular cores. When the amount thereof is less than 0.15 part by mass, sufficient adhesion of the organic pigment is difficult. Because the organic pigment can adhere sufficiently by the intermediate coat added in an amount of 0.15 to 45 parts by mass, the addition of an excess of the intermediate coat is meaningless.

The organic pigment is added to the granular cores coated with the intermediate coat, and the mixture is then stirred, whereby the organic pigment is adhered to the intermediate coat. If necessary, drying and heat treatment may be further carried out.

The organic pigment is added preferably little by little for a long time, especially for about 5 to 60 minutes. The amount of the organic pigment added is regulated in the range of 1 to 100 parts by mass, and preferably 5 to 50 parts by mass, relative to 100 parts by mass of the granular cores.

The mixing and stirring conditions are regulated suitably such that the line load is in the range of 19.6 to 1960 N/cm (2 to 200 kg/cm), preferably 98 to 1470 N/cm (10 to 150 kg/cm), and more preferably 147 to 980 N/cm (15 to 100 kg/cm) and the treatment time is in the range of 5 to 120 minutes, and preferably 10 to 90 minutes, so as to uniformly adhere the organic pigment to the cores. The treatment conditions may be regulated suitably such that the stirring rate is in the range of 2 to 2000 rpm, preferably 5 to 1000 rpm, and more preferably 10 to 800 rpm.

Electrophotographic Photoreceptor

Now, use of the photoconductive organic pigment obtained by the invention as a charge generating material in the electrophotographic photoreceptor is described.

The photoconductive organic pigment obtained by the invention can be applied to any structures, for example to those structures wherein the photosensitive layer in the electrophotographic photoreceptor has a single layer structure or a laminated structure separated functionally into a charge generating layer and a charge transporting layer.

Hereinafter, the laminated electrophotographic photoreceptor as a preferable embodiment is mainly described.

The electroconductive substrate in the electrophotographic photoreceptor of the invention may be any conventionally used substrate.

For example, the substrate can be formed into a metal drum made of aluminum, copper, iron, stainless steel, zinc and nickel, or may be a substrate in which a metal such as aluminum, copper, gold, silver, platinum, palladium, titanium, nickel-chrome, stainless steel, or indium or an electroconductive metallic compound such as indium oxide or tin oxide is deposited on a sheet, paper, plastics or glass, a laminated metal foil, or a binder resin rendered electrically conductive by dispersing therein or applying thereto carbon black, indium oxide, tin oxide, antimony oxide powder, metal powder or copper iodide.

Further, the shape of the electroconductive substrate may be not only in the form of a drum but also in the form of a sheet or a plate.

The surface of the electroconductive substrate can be subjected, if necessary, to various treatments in such a range that images are not adversely affected. For example, anodizing treatment of the surface, roughening treatment with liquid honing, chemical treatment, coloring treatment and the like can be conducted.

The laminated photoreceptor has an electroconductive substrate and photosensitive layers comprising at least a charge generating layer and a charge transporting layer, and either layer may be arranged in the vicinity of the substrate side.

The charge generating layer is formed from a photoconductive organic pigment dispersion liquid comprising the photoconductive organic pigment of the invention. The photoconductive organic pigment dispersion liquid of the invention is composed of the photoconductive organic pigment and a suitable binder resin solution.

The binder resin used can be any known binder resin. Preferable examples of the binder resin include, but are not limited to, insulating resins such as polyvinyl acetal resin, polyallylate resin (such as bisphenol A-phthalic acid polycondensate), polycarbonate resin, polyester resin, phenoxy resin, vinyl chloride-vinyl acetate copolymer, polyamide resin, acrylic resin, polyacrylamide resin, polyvinylpyridine resin, cellulose resin, urethane resin, epoxy resin, casein, polyvinyl alcohol resin, polyvinyl pyrrolidone resin. These binder resins can be used alone or in combination thereof. Among these, polyvinyl acetal resin is particularly preferably used.

The mixing ratio (by mass) of the photoconductive organic pigment to the binder resin is 40:1 to 1:4, and preferably 20:1 to 1:2. The percentage of the photoconductive organic pigment is predetermined preferably in the above range because if the percentage is too high, the stability of the coating solution is lowered, while if the percentage is too low, the light sensitivity is lowered.

The solvent used in dispersing the photoconductive organic pigment can be suitably selected from solvents dissolving the binder resin. For example, the solvent can be arbitrarily selected from alcohols, aromatics, halogenated hydrocarbons, ketones, ketone alcohols, ethers, and esters. For example, it is possible to use an ordinary organic solvent such as methanol, ethanol, n-propanol, iso-propanol, n-butanol, benzyl alcohol, methyl cellosolve, ethyl cellosolve, acetone, methyl ethyl ketone, cyclohexanone, methyl acetate, ethyl acetate, n-butyl acetate, dioxane, tetrahydrofuran, methylene chloride, chloroform, chlorobenzene, and toluene.

These dispersing solvents can be used alone or in combination thereof. When a combination of these solvents is used, any solvents can be used insofar as their mixed solvent can dissolve the binder resin.

The dispersing device used may be a sand mill, a colloid mill, an attritor, a ball mill, a dyno mill, a high-pressure homogenizer, an ultrasonic dispersing machine, a co-ball mill, and a roll mill. The coating method used may be blade coating, wire bar coating, spray coating, dip coating, bead coating, and curtain coating.

The thickness of the charge generating layer is in the range of 0.01 to 5 $\mu$m, and preferably in the range of 0.03 to 2 $\mu$m.

The charge transporting layer is composed mainly of a charge transporting material and a binder resin, and the charge transporting material may be a known suitable one.

Examples of the charge transporting material usable in the invention include hole transporting materials including oxadiazole derivatives such as 2,5-bis(p-diethylaminophenyl)-1,3,4-oxadiazole, pyrazoline derivatives such as 1,3,5-triphenyl-pyrazoline and 1-[pyridyl-(2)]-3-(p-diethylaminostyryl)-5-(p-diethylaminostyryl) pyra aromatic tertiary amino compounds such as triphenylamine, tri(p-methyl)phenylamine, N,N'-bis(3,4-dimethylphenyl) biphenyl-4-amine, dibenzyl aniline and 9,9-dimethyl-N,N'-di(p-tolyl)fluorenon-2-amine, aromatic tertiary diamino compounds such as N,N'-diphenyl-N,N'-bis(3-methylphenyl)-[1,1-biphenyl]-4,4'-diamine, 1,2,4-triazine derivatives such as 3-(4'-dimethylaminophenyl)-5,6-di-(4'-methoxyphenyl)-1,2,4-triazine, hydrazone derivatives such as 4-diethylaminobenzaldehyde-1,1-diphenyl hydrazone, 4-diphenylaminobenzaldehyde-1,1-diphenyl hydrazone and [p-(diethylamino)phenyl] (1-naphthyl)phenyl hydrazone, quinazoline derivatives such as 2-phenyl-4-styryl-quinazoline, benzofuran derivatives such as 6-hydroxy-2,3-di(p-methoxyphenyl)-benzofuran, $\alpha$-stilbene derivatives such as p-(2,2-diphenylvinyl)-N,N'-diphenyl aniline, enamine derivatives, carbazole derivatives such as N-ethylcarbazole, and poly-N-vinylcarbazole and derivatives thereof; electron transporting materials including quinone compounds such as chrolanil, bromanil and anthraquinone, tetracyanoquinodimethane compounds, fluorenone compounds such as 2,4,7-trinitrofluorenone and 2,4,5,7-tetranitro-9-fluorenone, oxadiazole compounds such as 2-(4-biphenyl)-5-(4-t-butylphenyl)-1,3,4-oxadiazole, 2,5-bis(4-naphthyl)-1,3,4-oxadiazole and 2,5-bis(4-diethylaminophenyl)-1,3,4-oxadiazole, xanthone compounds, thiophene compounds, and diphenoquinone compounds such as 3,3',5,5'-tetra-t-butyl diphenoquinone, as well as polymers whose main or side chain has a group composed of the above-described compounds. These charge transporting materials can be used alone or in combination thereof.

The binder resin usable in the invention may be any known resins, but is preferably a resin capable of forming an electrically insulating film. Examples thereof include, but are not limited to, polycarbonate resin, polyallylate resin, polyester resin, methacrylic resin, acrylic resin, polyvinyl chloride resin, polyvinylidene chloride resin, polystyrene resin, polyvinyl acetate resin, styrene-acrylonitrile copolymer, styrene-butadiene copolymer, vinylidene chloride-acrylonitrile copolymer, vinyl chloride-vinyl acetate copolymer, vinyl chloride-vinyl acetate-maleic anhydride terpolymer, silicone resin, polymethacrylate, styrene-methacrylate copolymer, polyolefin resin, silicone-alkyd resin, phenol-formaldehyde resin, styrene-alkyd resin, poly-N-carbazole, polyvinyl butyral, polyvinyl formal, polysulfone, casein, gelatin, polyvinyl alcohol, ethyl cellulose, phenol resin, polyamide, carboxy-methyl cellulose, vinylidene chloride polymer wax, and polyurethane. These binder resins can be used alone or as a mixture thereof, and a polycarbonate resin, polyester resin, methacrylic resin and acrylic resin are particularly preferably used because they are excellent in compatibility with the charge transporting material, in solubility in solvent, and in strength.

The compounding ratio (by mass) of the charge transporting material to the binder resin is 5:1 to 1:5, and preferably 3:1 to 1:3. The percentage of the charge transporting material is predetermined preferably in this range because if this percentage is too high, the mechanical strength of the charge transporting layer is decreased, while if the percentage is too low, the sensitivity is lowered. When the charge transporting material has film-forming properties, the binder resin may not be used.

The charge transporting layer is formed by dissolving the charge transporting material and the binder resin in a suitable solvent and applying the resulting solution, and the application method may be the same as that for the charge generating layer described above.

The thickness of the charge transporting layer is in the range of 5 to 50 $\mu$m, and preferably in the range of 10 to 40 $\mu$m.

When the photosensitive layer in the electrophotographic photoreceptor of the invention has a single layer structure, the photosensitive layer is formed from a photoconductive layer having the photoconductive organic pigment of the invention and the charge transporting material dispersed in the binder resin. Those materials in the charge transporting layer descried above can be suitably used as the charge transporting material in this case, and those materials in the charge transporting layer described above can be used as the binder resin, and the photosensitive layer can also be formed by any one of the methods described above.

The compounding ratio (by mass) of the charge transporting material to the binder resin is determined preferably in the range of 1:20 to 5:1, and the compounding ratio (by mass) of the photoconductive organic pigment to the charge transporting material is determined preferably in the range of 1:10 to 10:1.

In the invention, an undercoat layer may be arranged, if necessary, between the photosensitive layer and the electroconductive substrate. The undercoat layer is effective in inhibiting injection of unnecessary charge from the substrate to the photosensitive layer, and can improve the charging property of the electrophotographic photoreceptor. Further, it can also improve the adhesion between the photosensitive layer and the substrate.

The undercoat layer can be any known undercoat layer, for example an inorganic layer of anodized aluminum coating, aluminum oxide or aluminum hydroxide; an organic layer of polyvinyl alcohol, polyethylene, polyacrylic acid, cellulose or derivatives thereof, polyurethane, polyimide or polyamide; an organometallic compound layer such as zirconium chelate compound, zirconium alkoxide compound, titanyl chelate compound and titanyl alkoxide compound; and a silane coupling agent layer.

The thickness of the undercoat layer is in the range of 0.01 to 20 $\mu$m, and preferably 0.1 to 10 $\mu$m for the highest effectiveness.

If necessary, a protective layer may be formed on the photosensitive layer. The protective layer is formed by incorporating an electroconductive material into a suitable binder resin. Examples of the electroconductive material include, but are not limited to, metallocene compounds such as dimethyl ferrocene, aromatic amino compounds such as N,N'-bis-(m-tolyl)benzidine and metal oxides such as antimony oxide, tin oxide, titanium oxide, indium oxide and tin oxide-antimony oxide. Examples of the binder resin used in this protective layer include those exemplified above as the binder resin and electroconductive polymers. The protective layer is formed preferably such that its electric resistance becomes $10^9$ to $10^{14}$ $\Omega\cdot$cm. The thickness of this protective layer is determined in the range of 0.5 to 20 $\mu$m, and preferably 1 to 10 $\mu$m.

Electrophotographic Device

The electrophotographic photoreceptor of the invention can be applied to various printers such as laser printers, LED printers, CRT printers and full-color printers, and digital electrophotographic devices such as copiers, facsimiles, digital multifunction machines and full-color copiers.

The electrophotographic device of the invention has the electrophotographic photoreceptor of the invention, a charging unit for charging the electrophotographic photoreceptor, a light exposing unit for exposing imagewise the charged electrophotographic photoreceptor to light to form an electrostatic latent image on the surface of the electrophotographic photoreceptor, a developing unit for developing the electrostatic latent image so as to obtain a toner image, and a transferring unit for transferring the toner image to a recording material. The charging unit preferably charges the electrophotographic photoreceptor by bring the electrophotographic photoreceptor into contact with a charging member.

Figure 3:
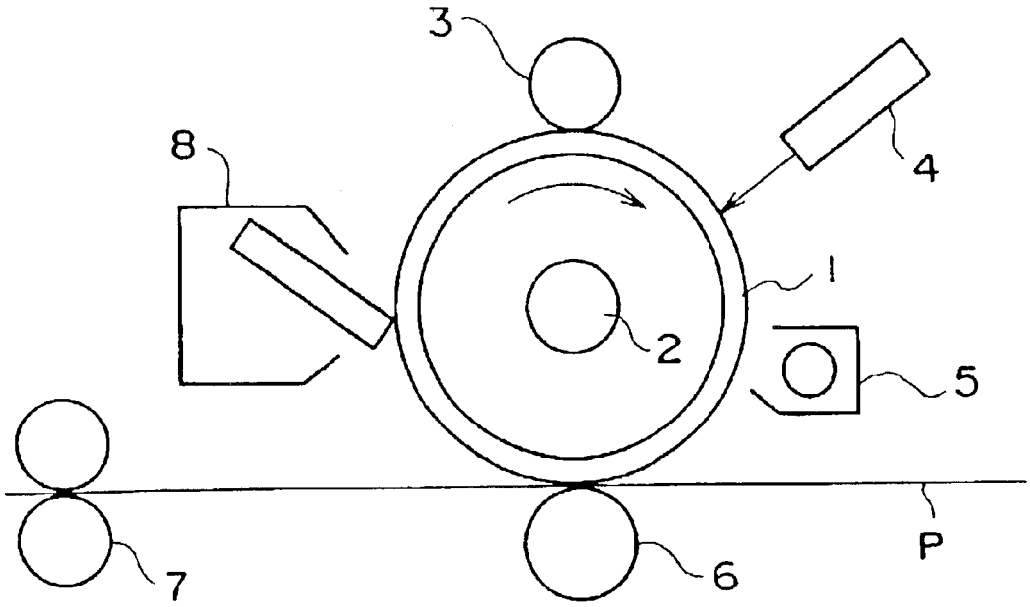
FIG. 3 shows an outline of an electrophotographic device having the electrophotographic photoreceptor of the present invention.

Now, the electrophotographic device of the invention is described by reference to the drawings. FIG. 3 shows one embodiment of the electrophotographic device of the invention.

The electrophotographic device shown in FIG. 3 has the electrophotographic photoreceptor 1 of the invention mounted therein, and is provided with a charging unit 3 for charging the electrophotographic photoreceptor 1, a light exposing unit 4 for light exposure of the electrophotographic photoreceptor 1 charged with the charging unit 3, to form an electrostatic latent image, a developing unit 5 for developing, by a toner, the electrostatic latent image formed by the light exposing unit 4 so as to obtain a toner image, a transferring unit 6 for transferring the toner image formed by the developing unit 5 to a recording medium, a cleaner unit 8 and a fixing unit 7.

Units other than the electrophotographic photoreceptor 1 including the charging unit 3, the light exposing unit 4, the developing unit 5, the transferring unit 6, and the cleaner device 8 are not particularly limited and can be suitably selected depending on the object.

Examples of the charging unit 3 usable in the invention include known charging devices including contact-type charging units using a conductive or semi-conductive roller, brush, film, or rubber blade, and Scorotron charging device and Corotron charging device using corona discharging.

Examples of the light exposing unit 4 usable in the invention include an optical device capable of exposing imagewise the surface of the electrophotographic photoreceptor to light from a light source such as a semiconductor laser, LED, and liquid crystal shutter.

Examples of the developing unit 5 usable in the invention include a known developing unit using a normal or reversal developing agent in one-component system, or two-component system.

Examples of the transferring unit 6 usable in the invention include known charging devices including contact-type charging units using a belt, roller, film, or rubber blade, and Scorotron transfer charging device and Corotron transfer charging device using corona discharging.

The transferring unit includes not only units for transferring directly a toner image to a recording medium such as paper and over head projector (OHP) sheet, but also intermediate transferring units utilizing an intermediate transfer system in which a toner image is transferred from the electrophotographic photoreceptor to an intermediate transfer medium and then is transferred from the intermediate transfer medium to a recording medium.

Examples of the intermediate transfer medium include that having an electroconductive substrate, an elastic layer formed from rubber, elastomer or resin, and at least one coating layer. The intermediate transfer medium is in the form of a roller, or a belt. Examples of the material used include materials comprising electroconductive carbon particles or metal powder dispersed in a resin such as polyurethane resin, polyester resin, polystyrene resin, polyolefin resin, polybutadiene resin, polyamide resin, polyvinyl chloride resin, polyethylene resin and fluororesin.

FIG. 3 shows a device using one electrophotographic photoreceptor, but the electrophotographic device of the invention may be an electrophotographic device in a tandem system having a plurality of photoreceptors whose number corresponds to the number of toner colors used. For example, such a device can have plural (e.g. four) units each of which has the electrophotographic photoreceptor 1, the charging unit 3, the light exposing unit 4, the developing unit 5 and the cleaner unit 8 and which are arranged around an intermediate transfer medium. The toner images formed in the respective units are primarily transferred to and layered on the intermediate transfer medium to form a composite toner image, and finally the composite toner image is secondarily transferred to a recording medium and fixed on the recording medium by a fixing unit to form an image on the recording medium.

The electrophotographic photoreceptors of the invention, when used particularly as a plurality of electrophotographic photoreceptors in the tandem system, can enable their sensitivity to be regulated independently, and are thus particularly advantageous in preventing color unevenness unique to color images resulting from sensitivity varying among the photoreceptors.

EXAMPLES

Hereinafter, the present invention is described in more detail by reference to the Examples and Comparative Examples, but the invention is not limited to the following examples. In the following examples, the "parts" means "parts by mass" unless otherwise noted.

Synthesis Example 1

Synthesis of V-Type Hydroxygallium Phthalocyanine Pigment 30 parts of 1,3-diiminoisoindoline and 9.1 parts of gallium trichloride are reacted with each other in 230 parts of dimethyl sulfoxide at 160° C. for 6 hours while stirring the mixture, to obtain reddish purple crystals. Then, the crystals are washed with dimethyl sulfoxide, then washed with deionized water and dried to obtain 28 parts of crude crystals of I-type chlorogallium phthalocyanine. 10 parts of the resulting crude crystals of I-type chlorogallium phthalocyanine are dissolved sufficiently in 300 parts of sulfuric acid (concentration: 97%) heated at 60° C., and then the resultant solution is added dropwise to a mixed solution of 600 parts of 25% ammonia water and 200 parts of deionized water to precipitate crystals and the crystals are then filtered out, washed with N,N-dimethylformamide and deionized water and dried to obtain 8 parts of I-type hydroxygallium phthalocyanine.

5 parts of the resulting I-type hydroxygallium phthalocyanine is mixed with 80 parts of N,N-dimethylformamide and the resultant mixture is stirred at 30° C. for 100 hours. Then, the product is washed with deionized water and dried to obtain 4.5 parts of V-type hydroxygallium phthalocyanine pigment. An X-ray diffraction pattern of the resulting V-type hydroxygallium phthalocyanine pigment powder is shown in FIG. 1. Measurement of the X-ray diffraction pattern is conducted by a powder method with X rays having CuKα characteristic under the following conditions:

Used measuring device: X-ray diffraction device Miniflex manufactured by Rigaku Denki Co., Ltd.

X-ray tube: Cu

Tube current: 15 mA

Scanning speed: 5.0 deg./min

Sampling interval: 0.02 deg

Start angle (2θ): 5 deg.

Stop angle (2θ): 35 deg.

Step angle (2θ): 0.02 deg.

Synthesis Example 2

Synthesis of II-Type Chlorogallium Phthalocyanine Pigment 5 parts of the I-type chlorogallium phthalocyanine obtained in Synthesis Example 1, together with 50 parts of alumina beads of 12 mm in diameter, are placed in an alumina pot. This pot is fit in a vibration mill (MB-1 model, manufactured by Chuo Kakoki Co., Ltd.) and the I-type chlorogallium phthalocyanine is milled in a dry system for 100 hours, to obtain 4.5 parts of chlorogallium phthalocyanine crystals. 4 parts of the resulting chlorogallium phthalocyanine crystals and 30 parts of dimethyl sulfoxide are dispersed with a ball mill at room temperature for 24 hours, washed with deionized water and filtered. Then, the resultant sample is vacuum-dried at 60° C. for 48 hours, to obtain 3.6 parts of II-type chlorogallium phthalocyanine pigment having a primary particle diameter of slightly smaller than 0.1 μm. An X-ray diffraction pattern of the resulting II-type chlorogallium phthalocyanine pigment powder is shown in Table 2.

Example 1-(1)

100 parts of fine silica particles having an average diameter of about 16 nm (AEROSIL 130, manufactured by AEROSIL) are introduced into an edge runner "MPUV-2 type" (product name, manufactured by K. K. Matsumoto Chuzo Tekkosho), and a solution obtained by mixing and diluting 2 parts of methyl triethoxy silane (trade name: TSL8123, manufactured by GE Toshiba Silicones) with 4 parts of ethanol is added to the fine silica particles in the running edge runner, and the mixture is stirred for 30 minutes at a stirring rate of 40 rpm under a line load of 200 N/cm. Then, 10 parts of the V-type hydroxygallium phthalocyanine pigment obtained in Synthesis Example 1 are added thereto over 10 minutes in the running edge runner, and the mixture is stirred for 20 minutes at a stirring rate of 40 rpm under a line load of 200 N/cm, thus coating the methyl triethoxy silane coating with the V-type hydroxygallium phthalocyanine pigment. Fine particles of the photoconductive organic pigment coated with the V-type hydroxygallium phthalocyanine pigment are thus obtained. As a result of observation under an electron microscope, primary particles of only the V-type hydroxygallium phthalocyanine pigment are hardly observed, and thus it is confirmed that almost all the pigment is adhered to the organosilane compound coating formed from methyl triethoxy silane.

Example 1-(2) to (5)

Fine photoconductive organic pigment particles coated with the V-type hydroxygallium phthalocyanine pigment are prepared by repeating 4 times the production method in Example 1-(1), to obtain the samples in Examples 1-(2) to (5), respectively.

Example 2-(1) to (3)

Fine photoconductive organic pigment particles coated with the V-type hydroxygallium phthalocyanine pigment are prepared in the same manner as in Example 1-(1) except that the amount of the V-type hydroxygallium phthalocyanine pigment added is changed to 20 parts, 50 parts and 90 parts, respectively, to obtain the samples in Example 2-(1) to (3), respectively.

Example 3-(1)

Fine photoconductive organic pigment particles coated with the II-type chlorogallium phthalocyanine pigment are prepared in the same manner as in Example 1-(1) except that the II-type chlorogallium phthalocyanine pigment prepared in Synthesis Example 2 is used in place of the V-type hydroxygallium phthalocyanine pigment in Example 1-(1).

Example 3-(2) to (5)

Fine photoconductive organic pigment particles coated with the II-type chlorogallium phthalocyanine pigment are prepared by repeating 4 times the production method in Example 3-(1), to obtain the samples in Examples 3-(2) to (5), respectively.

Comparative Example 1-(1) to (4)

The V-type hydroxygallium phthalocyanine pigments are prepared by repeating 4 times the same production method in Synthesis Example 1, to obtain the samples in Comparative Example 1-(1) to (4), respectively.

Comparative Example 2-(1) to (4)

The II-type chlorogallium phthalocyanine pigments are prepared by repeating 4 times the production method in Synthesis Example 2, to obtain the samples in Comparative Example 2-(1) to (4), respectively.

Comparative Example 3-(1) to (4)

An α-type titanyl phthalocyanine pigment and β-type titanyl phthalocyanine pigment are mixed in the ratios of 90:10, 70:30, 50:50 and 30:70, to obtain mixed pigments of the α-type titanyl phthalocyanine pigment and β-type titanyl phthalocyanine pigment in Comparative Example 3-(1) to (4), respectively.

Example 4-(1)

A mixture consisting of 100 parts of 50% toluene solution of tributoxyzirconium acetylacetonate (trade name: ZC-540, manufactured by Matsumoto Kosho Co., Ltd.), 10 parts of γ-aminopropyl triethoxy silane (trade name: A1100, manufactured by Nippon Unicar Company Limited) and 130 parts of n-butyl alcohol is added to a solution prepared by dissolving 8 parts of polyvinyl butyral resin (S-Lec BM-1, manufactured by Sekisui Chemical Co., Ltd.) in 152 parts of n-butyl alcohol, and the mixture is stirred to prepare an undercoat layer coating solution. An aluminum sheet of 50 μm in thickness is dipped in this coating solution, and the resultant coating layer is dried at 150° C. for 10 minutes, to form an undercoat layer of 1.0 μm in thickness thereon. Separately, a solution prepared by dissolving 1 part of vinyl chloride-vinyl acetate copolymer resin (VMCH, manufactured by Nippon Unicar Company Limited) in 100 parts of n-butyl acetate is mixed with 1 part of the fine V-type hydroxygallium phthalocyanine pigment particles obtained in Example 1-(1) and glass beads, and they are mixed with a sand mill for 3 hours, to prepare a charge generating layer coating solution. The aluminum sheet having the undercoat layer is dipped in the resulting coating solution, and then the resultant coating layer is dried at 100° C. for 10 minutes, to form a charge generating layer of 0.20 μm in thickness on the undercoat layer.

Then, a charge transporting layer is formed on the charge generating layer thus formed as follows. 5 parts of N,N-bis-(3,4-dimethylphenyl)biphenyl-4-amine as the charge transporting material is dissolved together with 5 parts of polycarbonate Z resin in 40 parts of monochlorobenzene, and the resulting solution is applied by an dipping coating device onto the charge generating layer and then dried at 120° C. for 40 minutes to form a charge transporting layer of 20 μm in thickness. An electrophotographic photoreceptor sheet is thus obtained. Separately, an aluminum pipe having a diameter of 84 mm and a length of 347 mm is roughened by honing in a wet system such that the central line average roughness Ra became 0.18 μm, and then coated successively with the undercoat layer coating solution, the charge generating layer coating solution, and the charge transporting layer coating solution in this order, to prepare an electrophotographic photoreceptor drum.

Example 4-(2) to (5)

Electrophotographic photoreceptor sheets and electrophotographic photoreceptor drums are prepared in the same manner as in Example 4-(1) except that the fine V-type hydroxygallium phthalocyanine pigment particles in Example 1-(2) to (5) are used in place of the fine V-type hydroxygallium phthalocyanine pigment particles in Example I-(1), to obtain the samples in Examples 4-(2) to (5), respectively.

Example 5-(1) to (3)

Electrophotographic photoreceptor sheets and electrophotographic photoreceptor drums are prepared in the same manner as in Example 4-(1) except that the fine V-type hydroxygallium phthalocyanine pigment particles in Example 2-(1) to (3) are used in place of the fine V-type hydroxygallium phthalocyanine pigment particles in Example I-(1), to obtain the samples in Examples 5-(1) to (3), respectively.

Example 6-(1) to (5)

Electrophotographic photoreceptor sheets and electrophotographic photoreceptor drums are prepared in the same manner as in Example 4-(1) except that the fine II-type chlorogallium phthalocyanine pigment particles in Example 3-(1) to (5) are used in place of the fine V-type hydroxygallium phthalocyanine pigment particles in Example I-(1), to obtain the samples in Examples 6-(1) to (5), respectively.

Comparative Example 4-(1) to (4)

Electrophotographic photoreceptor sheets and electrophotographic photoreceptor drums are prepared in the same manner as in Example 4-(1) except that the V-type hydroxygallium phthalocyanine pigments in Comparative Example 1-(1) to (4) are used in place of the fine V-type hydroxygallium phthalocyanine pigment particles in Example I-(1), to obtain the samples in Comparative Examples 4-(1) to (4), respectively.

Comparative Example 5-(1) to (4)

Electrophotographic photoreceptor sheets and electrophotographic photoreceptor drums are prepared in the same manner as in Example 4-(1) except that the II-type chlorogallium phthalocyanine pigments in Comparative Example 2-(1) to (4) are used in place of the fine V-type hydroxygallium phthalocyanine pigment particles in Example 1-(1), to obtain the samples in Comparative Examples 5-(1) to (4), respectively.

Comparative Example 6-(1) to (4)

Electrophotographic photoreceptor sheets and electrophotographic photoreceptor drums are prepared in the same manner as in Example 4-(1) except that the mixed pigments of α-type titanyl phthalocyanine pigment and β-type titanyl phthalocyanine pigment in Comparative Example 3-(1) to (4) are used in place of the fine V-type hydroxygallium phthalocyanine pigment particles in Example I-(1), to obtain the samples in Comparative Examples 6-(1) to (4), respectively.

Evaluation of the Characteristics of the Photoreceptors

To evaluate the electrophotographic characteristics of the electrophotographic photoreceptor sheets, the following measurement is conducted. Using an electric paper analyzer (EPA8200, manufactured by Kawaguchi Electric Works Co., Ltd.), the photoreceptors to be examined are negatively charged through a small mask having a diameter of 20 mm by corona discharging at −5.0 kV in the environment of 20° C. and 50% RH, and then irradiated through an interference filter with a light at 780 nm from a halogen lamp such that the surfaces of the photoreceptors are irradiated with the light at an intensity of 5.0 $\mu$W/cm$^2$. The initial surface potential V0 (V), the half-reduction exposure E1/2 ($\mu$J/cm$^2$) when the obtained potential became half of V0, and the dark decay rate (DDR) (%) one second after charging are measured. The results are shown in Table 1.

Evaluation of Images

The photographic photoreceptor drum is fit in a full-color laser printer (DocuPrint C411, manufactured by Fuji Xerox Co., Ltd.) to evaluate image qualities. The full-color laser printer uses a bias charge roll unit (BCR) as a charging unit, a raster output scanner (ROS) using a semiconductor laser which can irradiate exposure light having a wavelength of 780 mm as a light exposing unit, a two-component reversal development system as a development system, a bias charge roll unit and an intermediate belt transfer system (IBT) as a transferring unit. Because the respective electrophotographic photoreceptor drums have different sensitivity, the amount of light of the ROS is regulated to make image density constant. The results are shown in Table 2.

Evaluation of the Dispersibility of the Charge Generating Layer Coating Solution To evaluate the dispersibility of the charge generating layer coating solution, samples are prepared by forming a charge generating layer made of the respective charge generating layer coating solutions on a glass plate. When the surface of a sample is observed under a microscope and aggregation of pigments is not observed, the sample is evaluated to be good. When aggregation of pigments or a rough coating surface is observed, the sample is evaluated to be not good. These results are shown in Table 2.

TABLE 1

| | | Photoconductive organic pigment | | | | Characteristics of photoreceptor | | |
|---|---|---|---|---|---|---|---|---|
| Photographic photoreceptor | Charge generating material | Pigment | Amount of pigment added to 100 parts of cores (parts by mass) | Average major-axis length (nm) | Shape of photoconductive organic pigment | V0 (V) | E1/2 ($\mu$J/cm$^2$) | DDR (%) |
| Example 4-(1) | Example 1-(1) | HOGaPc | 10 | 25 | Spherical | −487 | 1.15 | 4.6 |
| Example 4-(2) | Example 1-(2) | HOGaPc | 10 | 34 | Spherical | −489 | 1.14 | 4.8 |
| Example 4-(3) | Example 1-(3) | HOGaPc | 10 | 28 | Spherical | −482 | 1.16 | 5.2 |
| Example 4-(4) | Example 1-(4) | HOGaPc | 10 | 31 | Spherical | −487 | 1.09 | 5.1 |
| Example 4-(5) | Example 1-(5) | HOGaPc | 10 | 28 | Spherical | −479 | 1.11 | 5.5 |
| Example 5-(1) | Example 2-(1) | HOGaPc | 20 | 37 | Spherical | −483 | 0.75 | 7.2 |
| Example 5-(2) | Example 2-(2) | HOGaPc | 50 | 113 | Spherical | −490 | 0.61 | 9.4 |
| Example 5-(3) | Example 2-(3) | HOGaPc | 90 | 684 | Spherical | −478 | 0.47 | 11.3 |
| Example 6-(1) | Example 3-(1) | ClGaPc | 10 | 46 | Spherical | −498 | 0.88 | 8.9 |
| Example 6-(2) | Example 3-(2) | ClGaPc | 10 | 37 | Spherical | −482 | 0.82 | 9.4 |
| Example 6-(3) | Example 3-(3) | ClGaPc | 10 | 34 | Spherical | −489 | 0.87 | 8.7 |
| Example 6-(4) | Example 3-(4) | ClGaPc | 10 | 35 | Spherical | −479 | 0.89 | 9.2 |
| Example 6-(5) | Example 3-(5) | ClGaPc | 10 | 39 | Spherical | −477 | 0.85 | 8.9 |
| Comparative Example 4-(1) | Comparative Example 1-(1) | HOGaPc | | 863 | Indefinite | −487 | 0.61 | 8.2 |
| Comparative Example 4-(2) | Comparative Example 1-(2) | HOGaPc | | 716 | Indefinite | −485 | 0.97 | 11.1 |
| Comparative Example 4-(3) | Comparative Example 1-(3) | HOGaPc | | 546 | Indefinite | −476 | 0.45 | 9.7 |
| Comparative Example 4-(4) | Comparative Example 1-(4) | HOGaPc | | 1034 | Indefinite | −471 | 0.45 | 13.8 |
| Comparative Example 5-(1) | Comparative Example 2-(1) | ClGaPc | | 635 | Indefinite | −478 | 1.18 | 11.5 |
| Comparative Example 5-(2) | Comparative Example 2-(2) | ClGaPc | | 568 | Indefinite | −452 | 1.20 | 10.7 |
| Comparative Example 5-(3) | Comparative Example 2-(3) | ClGaPc | | 993 | Indefinite | −476 | 0.97 | 13.6 |
| Comparative Example 5-(4) | Comparative Example 2-(4) | ClGaPc | | 587 | Indefinite | −463 | 1.10 | 12.2 |
| Comparative Example 6-(1) | Comparative Example 3-(1) | αTiOPC:βTiOPC = 90:10 | | 706 | Indefinite | −477 | 0.94 | 13.5 |
| Comparative Example 6-(2) | Comparative Example 3-(2) | αTiOPC:βTiOPC = 70:30 | | 817 | Indefinite | −449 | 1.56 | 18.7 |
| Comparative Example 6-(3) | Comparative Example 3-(3) | αTiOPC:βTiOPC = 50:50 | | 882 | Indefinite | −418 | 2.64 | 17.1 |
| Comparative Example 6-(4) | Comparative Example 3-(4) | αTiOPC:βTIOPC = 30:70 | | 1223 | Indefinite | −419 | 4.37 | 16.2 |

TABLE 2

| Photographic photoreceptor | Charge generating material | Photoconductive organic pigment: Pigment | Amount of pigment added to 100 parts of cores (parts by mass) | Average major-axis length (nm) | Shape of photoconductive organic pigment | Quality of image | Evaluation of the dispersibility of the charge generating material |
|---|---|---|---|---|---|---|---|
| Example 4-(1) | Example 1-(1) | HOGaPc | 10 | 25 | Spherical | Good | Good |
| Example 4-(2) | Example 1-(2) | HOGaPc | 10 | 34 | Spherical | Good | Good |
| Example 4-(3) | Example 1-(3) | HOGaPc | 10 | 28 | Spherical | Good | Good |
| Example 4-(4) | Example 1-(4) | HOGaPc | 10 | 31 | Spherical | Good | Good |
| Example 4-(5) | Example 1-(5) | HOGaPc | 10 | 28 | Spherical | Good | Good |
| Example 5-(1) | Example 2-(1) | HOGaPc | 20 | 37 | Spherical | Good | Good |
| Example 5-(2) | Example 2-(2) | HOGaPc | 50 | 113 | Spherical | Good | Good |
| Example 5-(3) | Example 2-(3) | HOGaPc | 90 | 684 | Spherical | Good | Good |
| Example 6-(1) | Example 3-(1) | ClGaPc | 10 | 46 | Spherical | Good | Good |
| Example 6-(2) | Example 3-(2) | ClGaPc | 10 | 37 | Spherical | Good | Good |
| Example 6-(3) | Example 3-(3) | ClGaPc | 10 | 34 | Spherical | Good | Good |
| Example 6-(4) | Example 3-(4) | ClGaPc | 10 | 35 | Spherical | Good | Good |
| Example 6-(5) | Example 3-(5) | ClGaPc | 10 | 39 | Spherical | Good | Good |
| Comparative Example 4-(1) | Comparative Example 1-(1) | HOGaPc | | 863 | Indefinite | Good | Good |
| Comparative Example 4-(2) | Comparative Example 1-(2) | HOGaPc | | 716 | Indefinite | Generation of black spots | Not good |
| Comparative Example 4-(3) | Comparative Example 1-(3) | HOGaPc | | 546 | Indefinite | Good | Good |
| Comparative Example 4-(4) | Comparative Example 1-(4) | HOGaPc | | 1034 | Indefinite | Generation of black spots | Not good |
| Comparative Example 5-(1) | Comparative Example 2-(1) | ClGaPc | | 635 | Indefinite | Good | Good |
| Comparative Example 5-(2) | Comparative Example 2-(2) | ClGaPc | | 568 | Indefinite | Insufficient density | Not good |
| Comparative Example 5-(3) | Comparative Example 2-(3) | ClGaPc | | 993 | Indefinite | Generation of black spots | Not good |
| Comparative Example 5-(4) | Comparative Example 2-(4) | ClGaPc | | 587 | Indefinite | Good | Good |
| Comparative Example 6-(1) | Comparative Example 3-(1) | αTiOPC:βTiOPC = 90:10 | | 706 | Indefinite | Generation of black spots | Not good |
| Comparative Example 6-(2) | Comparative Example 3-(2) | αTiOPC:βTiOPC = 70:30 | | 817 | Indefinite | Good | Good |
| Comparative Example 6-(3) | Comparative Example 3-(3) | αTiOPC:βTiOPC = 50:50 | | 882 | Indefinite | Insufficient density | Not good |
| Comparative Example 6-(4) | Comparative Example 3-(4) | αTiOPC:βTiOPC = 30:70 | | 1223 | Indefinite | Insufficient density | Not good |

In Table 1, HOGaPC represents hydroxygallium phthalocyanine, ClGaPC represents chlorogallium phthalocyanine, αTiOPC represents α-type titanyl phthalocyanine, and βTiOPC represents β-type titanyl phthalocyanine.

As can be seen from the results in Tables 1 and 2, the V-type hydroxygallium phthalocyanine pigments prepared in Comparative Examples 1-(1) to (4) and the II-type chlorogallium phthalocyanine pigments prepared in Comparative Example 2-(1) to (4), though being prepared in the same process, have significantly varying sensitivity and dispersibility, and thus the sensitivity of the electrophotographic photoreceptors using these pigments and qualities of images obtained in the electrophotographic devices using the electrophotographic photoreceptors are also varied. Further, it can be seen that the mixed titanyl phthalocyanine pigments in Comparative Examples 3-(1) to (4) show a narrower range of their regulated sensitivity and are inferior in dispersibility, and thus the electrophotographic photoreceptors using them can easily cause problems with image qualities.

On the other hand, it can be seen that the photoconductive organic pigments in the Examples of the invention, comprising granular cores coated with an organic pigment having photoconductive properties, attain a smaller particle diameter to improve dispersibility, and can control their sensitivity in a broad range by controlling the amount of the organic pigment added to the granular cores, and can thus be used to produce electrophotographic photoreceptors exhibiting the optimum sensitivity in the electrophotographic process and giving high-quality images.

What is claimed is:

1. A photo conductive organic pigment comprising granular cores and an organic pigment having photoconductive properties which organic pigment adheres to the surfaces of the granular particles, wherein the amount of the organic pigment having photoconductive properties is 1 to 100 parts by mass based on 100 parts by mass of the granular cores, and wherein the average major-axis length of the photoconductive organic pigment is 5 to 1000 nm.

2. A photoconductive organic pigment according to claim 1, which has a spherical or elliptical shape.

3. A photoconductive organic pigment according to claim 1, wherein the granular core comprises a fine inorganic particle.

4. A photoconductive organic pigment according to claim 1, wherein the granular core comprises at least one kind of fine inorganic particle selected from a group consisting of silica, titanium oxide, iron oxide, iron hydroxide, zinc oxide and alumina.

5. A photoconductive organic pigment according to claim 1, wherein the surfaces of the granular cores are coated with an intermediate coat, and the organic pigment having photoconductive properties adheres to the intermediate coat.

6. A photoconductive organic pigment according to claim 5, wherein the intermediate coat comprises at least one of an organosilane compound formed from alkoxysilane, and polysiloxane.

7. A photoconductive organic pigment according to claim 5, wherein the intermediate coat comprises at least one selected from a group consisting of aluminum hydroxide, aluminum oxide, silicon hydroxide and silicon oxide.

8. A photoconductive organic pigment according to claim 1, wherein the organic pigment having photoconductive properties is a phthalocyanine pigment.

9. A photoconductive organic pigment dispersion liquid comprising the photoconductive organic pigment of claim 1.

10. An electrophotographic photoreceptor comprising an electroconductive substrate laminated with a photosensitive layer containing a photoconductive organic pigment comprising granular cores and an organic pigment having photoconductive properties which organic pigment adheres to the surface of the granular cores, wherein the amount of the organic pigment having photoconductive properties is 1 to 100 parts by mass based on 100 parts by mass of the granular cores, and wherein the average major-axis length of the photoconductive organic pigment is 5 to 1000 nm.

11. An electrophotographic photoreceptor according to claim 10, wherein the photosensitive layer has a charge generating layer and a charge transporting layer, and the charge generating layer contains the photoconductive organic pigment.

12. An electrophotographic photoreceptor according to claim 10, wherein the photoconductive organic pigment is particles having a spherical or elliptical shape.

13. An electrophotographic photoreceptor according to claim 10, wherein the granular core of the photoconductive organic pigment is comprised of a fine inorganic particle.

14. An electrophotographic photoreceptor according to claim 10, wherein the granular core of the photoconductive organic pigment is at least one kind of fine inorganic particle selected from a group consisting of silica, titanium oxide, iron oxide, iron hydroxide, zinc oxide and alumina.

15. An electrophotographic photoreceptor according to claim 10, wherein the surfaces of the granular cores of the photoconductive organic pigment are coated with an intermediate coat, and the organic pigment having photoconductive properties adheres to the intermediate coat.

16. An electrophotographic device comprising the electrophotographic photoreceptor of claim 10, a charging unit for charging the electrophotographic photoreceptor, a light exposing unit for exposing imagewise the charged electrophotographic photoreceptor to light to form an electrostatic latent image on the surface of the electrophotographic photoreceptor, a developing unit for developing the electrostatic latent image so as to obtain a toner image, and a transferring unit for transferring the toner image to a recording material.

* * * * *